US011454134B2

(12) United States Patent
Hopper et al.

(10) Patent No.: US 11,454,134 B2
(45) Date of Patent: Sep. 27, 2022

(54) DAMPER CONTROL VALVE FOR A TURBOMACHINE

(71) Applicant: General Electric Company, Schenectady, NY (US)

(72) Inventors: Mark Leonard Hopper, West Chester, OH (US); Justin Adam Masters, Cincinnati, OH (US); Jacob Patrick Miller, Blue Ash, OH (US); Roger Lee Doughty, Pleasant Plain, OH (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 97 days.

(21) Appl. No.: 16/985,392

(22) Filed: Aug. 5, 2020

(65) Prior Publication Data

US 2022/0042423 A1 Feb. 10, 2022

(51) Int. Cl.
*F01D 25/16* (2006.01)
*F01D 25/04* (2006.01)

(52) U.S. Cl.
CPC ..... *F01D 25/164* (2013.01); *F01D 25/04* (2013.01); *F05D 2220/323* (2013.01); *F05D 2240/54* (2013.01); *F05D 2240/60* (2013.01); *F05D 2260/60* (2013.01); *F05D 2260/96* (2013.01)

(58) Field of Classification Search
CPC ..... F01D 25/164
See application file for complete search history.

(56) References Cited

U.S. PATENT DOCUMENTS

| | | | | |
|---|---|---|---|---|
| 4,782,919 | A | 11/1988 | Chalaire et al. | |
| 5,320,134 | A | 6/1994 | Singh | |
| 5,344,239 | A * | 9/1994 | Stallone | F01D 25/164 384/99 |
| 7,329,048 | B2 | 2/2008 | Kinsman et al. | |
| 10,156,158 | B2 | 12/2018 | Davis | |
| 10,495,143 | B2 * | 12/2019 | Gysling | F16C 27/045 |
| 10,746,222 | B2 * | 8/2020 | Steen | F16C 27/045 |
| 10,920,615 | B2 * | 2/2021 | Jonsson | F16F 15/0237 |
| 11,162,609 | B2 * | 11/2021 | Magette | F16K 31/1221 |
| 2017/0307046 | A1 * | 10/2017 | Steen | F01D 25/164 |
| 2018/0245632 | A1 | 8/2018 | Obara et al. | |
| 2018/0363501 | A1 | 12/2018 | Moda et al. | |
| 2018/0371998 | A1 | 12/2018 | Sheridan | |
| 2019/0071997 | A1 * | 3/2019 | Jonsson | F02C 7/06 |
| 2019/0071998 | A1 * | 3/2019 | Gysling | F01D 25/164 |
| 2019/0120254 | A1 * | 4/2019 | Duffy | F16C 35/077 |
| 2021/0048111 | A1 * | 2/2021 | Magette | F16K 31/1221 |

* cited by examiner

*Primary Examiner* — Juan G Flores
(74) *Attorney, Agent, or Firm* — Venable LLP; Peter T. Hrubiec; Michele V. Frank

(57) ABSTRACT

A gas turbine engine having a damping system that includes features for optimizing the damping response to vibrational loads on a rotary component for a wide range of operational conditions is provided. In one aspect, the damping system includes a damper control valve. The damper control valve receives working fluid from a working fluid supply and has a valve plunger movable between a first position and a second position. When the valve plunger is in the first position, the damper control valve permits working fluid to flow to a first damper associated with a first bearing coupled with the rotary component and to a second damper associated with a second bearing coupled with the rotary component. When the valve plunger is in the second position, the damper control valve permits working fluid to flow to the first damper but not the second damper.

20 Claims, 4 Drawing Sheets

DAMPER CONTROL VALVE FOR A TURBOMACHINE

FIELD

The present subject matter relates generally to a dual damper control valve for a turbomachine, such as a gas turbine engine.

BACKGROUND

Rotary components of turbomachines can experience a wide range of vibrational loads during operation. For instance, a rotor of an aviation gas turbine engine can experience a large range of vibrational amplitudes and eccentricities depending on the operational conditions of the engine. Typically, one or more bearing assemblies support one or more shafts of the rotor. The shafts are typically supported and retained by the bearing assemblies and vibrational loads are controlled and dampened by dampers, such as squeeze film dampers.

To maintain proper rotor stability of a rotor for an aviation gas turbine engine, more damping is typically required at the bearing assemblies during engine startup than during high power engine speeds, particularly at the forward high speed bearing. Too much damping at high speeds has been shown to be too stiff for proper rotor stability and insufficient damping at engine startup can cause rotor instability, leading to high unbalanced or high eccentricity conditions.

Therefore, improved damping systems and methods of varying the damping response to vibration loads experienced by a rotary component of a turbomachine for a wide range of operational conditions would be useful.

BRIEF DESCRIPTION

Aspects and advantages of the invention will be set forth in part in the following description, or may be obvious from the description, or may be learned through practice of the invention.

In one aspect, a turbomachine is provided. The turbomachine includes a rotary component rotatable about an axis of rotation. The turbomachine also includes a bearing assembly having one or more bearings each operatively coupled with the rotary component, each of the one or more bearings having a damper associated therewith, each of the dampers defining one or more chambers. Further, the turbomachine includes a damper control valve having a valve casing defining a valve chamber, the valve chamber being in fluid communication with a working fluid supply and the one or more chambers, the damper control valve operable to receive working fluid from the working fluid supply. In addition, the damper control valve has a valve plunger movable within the valve chamber between a first position in which working fluid flows to at least two chambers of the one or more chambers and a second position in which working fluid flows to at least one less chamber than the at least two chambers to which working fluid flows when the valve plunger is in the first position.

In another aspect, a gas turbine engine is provided. The gas turbine engine includes a rotary component rotatable about an axis of rotation. The gas turbine engine also includes a first bearing operatively coupled with the rotary component and a first damper associated with the first bearing, the first damper defining a first chamber. Further, the gas turbine engine includes a second bearing operatively coupled with the rotary component and a second damper associated with the second bearing, the second damper defining a second chamber. The gas turbine engine also includes a damper control valve having a valve casing defining a valve chamber, the valve chamber being in fluid communication with the first chamber of the first damper and being in selective fluid communication with the second chamber of the second damper, wherein the damper control valve has a valve plunger movable within the valve chamber between a first position in which working fluid flows to both the first chamber and the second chamber and a second position in which working fluid flows to the first chamber but not the second chamber.

In yet another aspect, a gas turbine engine is provided. The gas turbine engine includes a rotary component rotatable about an axis of rotation. The gas turbine engine also includes a bearing operatively coupled with the rotary component. Further, the gas turbine engine includes a first damper associated with the bearing, the first damper defining a first chamber. The gas turbine engine also includes a second damper associated with the bearing, the second damper defining a second chamber. Further, the gas turbine engine includes a damper control valve having a valve casing defining a valve chamber, the valve chamber being in fluid communication with the first chamber of the damper and being in selective fluid communication with the second chamber of the damper, wherein the damper control valve has a valve plunger movable within the valve chamber between a first position in which working fluid flows to both the first chamber and the second chamber and a second position in which working fluid flows to the first chamber but not the second chamber.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION

Figure 1:
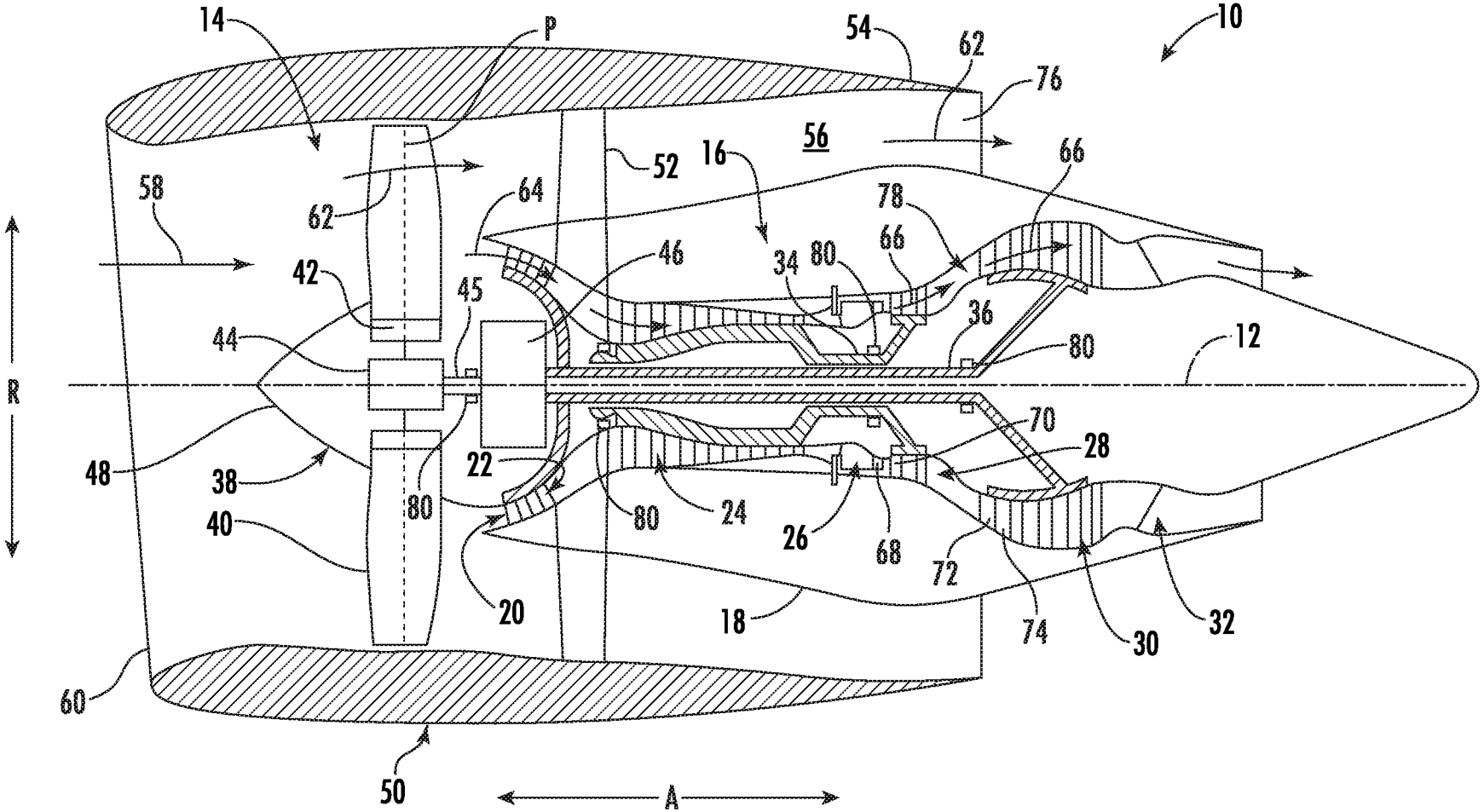
FIG. 1 provides a schematic cross-sectional view of an exemplary gas turbine engine according to various embodiments of the present disclosure.

Reference will now be made in detail to present embodiments of the invention, one or more examples of which are illustrated in the accompanying drawings. Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of any claims and their equivalents.

The detailed description uses numerical and letter designations to refer to features in the drawings. Like or similar designations in the drawings and description have been used to refer to like or similar parts of the invention, and identical numerals indicate the same elements throughout the drawings. As used herein, the terms "first", "second", and "third" may be used interchangeably to distinguish one component from another and are not intended to signify location or relative importance of the individual components. The terms "upstream" and "downstream" refer to the relative direction with respect to fluid flow in a fluid pathway. For example, "upstream" refers to the direction from which the fluid flows, and "downstream" refers to the direction to which the fluid flows.

Aspects of the present disclosure are directed to a turbomachine (e.g., an aviation gas turbine engine) having a damping system that includes features for optimizing the damping response to vibrational loads of a rotary component for a wide range of operational conditions. In one example aspect, the damping system includes a damper control valve that controls the flow of working fluid (e.g., oil) to a first damper and a second damper. The first damper is associated with a main or first bearing operatively coupled with the rotary component and the second damper is associated with a second bearing operatively coupled with the rotary component. The first bearing and the second bearing collectively form a bearing assembly. The bearing assembly can be a forward high speed bearing assembly, for example. The damper control valve receives working fluid from a working fluid supply and selectively directs working fluid to one or both of the dampers. The damper control valve has a valve plunger movable between a first position and a second position. A biasing member, such as a spring, biases the valve plunger in the first position.

During engine startup, the valve plunger biased in the first position permits working fluid to flow to both the first damper and the second damper. Accordingly, when the valve plunger is in the first position, both dampers are fed working fluid and operate to eliminate rotor instability. Particularly, at engine startup, the damper control valve allows working fluid to flow from the working fluid supply along a priority line or a second valve supply line into the valve chamber and downstream to the first damper along a first damper supply line and downstream to the second damper along a second damper supply line. In some embodiments, an accumulator is positioned along the first damper supply line to provide working fluid to the first damper during working fluid interruption events. A bearing oil supply line or first valve supply line that fluidly couples the working fluid supply and the damper control valve is blocked by the valve plunger when the valve plunger is in the first position. When both the first and second dampers are supplied working fluid, they both act to damp the rotary component to keep it stable during startup.

As the engine spools up, the pressure of the working fluid increases. Eventually, the working fluid reaches a pressure threshold or point at which the working fluid flowing actuates or moves the valve plunger from the first position to the second position. With the valve actuated to the second position, the damper control valve permits working fluid to flow to the first damper but not the second damper. Specifically, when the valve plunger is in the second position, the damper control valve allows working fluid to flow from the working fluid supply along the first valve supply line into the valve chamber and downstream to the first damper along the first damper supply line. The valve plunger blocks working fluid from flowing from the working fluid supply downstream along the second valve supply line into the valve chamber. Accordingly, working fluid is prevented from flowing to the second damper along the second damper supply line. Blocking working fluid from reaching the second damper allows the high-speed bearing damping to be reduced to a stiffness that is appropriate for rotor stability at high engine speeds.

In one example aspect, a turbomachine is provided. The turbomachine can be a gas turbine engine, such a gas turbine engine for an aerial vehicle. Stated another way, the turbomachine can be an aviation gas turbine engine. The turbomachine includes a rotary component rotatable about an axis of rotation. As one example, the rotary component can be a high pressure shaft or spool of an aviation gas turbine engine. As another example, the rotary component can be a low pressure shaft or spool of an aviation gas turbine engine. The turbomachine includes a bearing assembly having one or more bearings each operatively coupled with the rotary component. Each of the one or more bearings have a damper associated therewith. Each damper defines one or more chambers operable to receive working fluid.

The turbomachine further includes a damper control valve having a valve casing defining a valve chamber. The valve chamber is in fluid communication with a working fluid supply and the one or more chambers of the respective dampers. The damper control valve is operable to receive working fluid from the working fluid supply and to direct working fluid to select dampers of the one or more dampers. Further, the damper control valve has a valve plunger movable within the valve chamber between a first position and a second position. When the valve plunger is in the first position, working fluid flows to at least two chambers of the one or more chambers. When the valve plunger is in the second position, working fluid flows to at least one less chamber than the at least two chambers to which working fluid flows when the valve plunger is in the first position.

Figure 2:
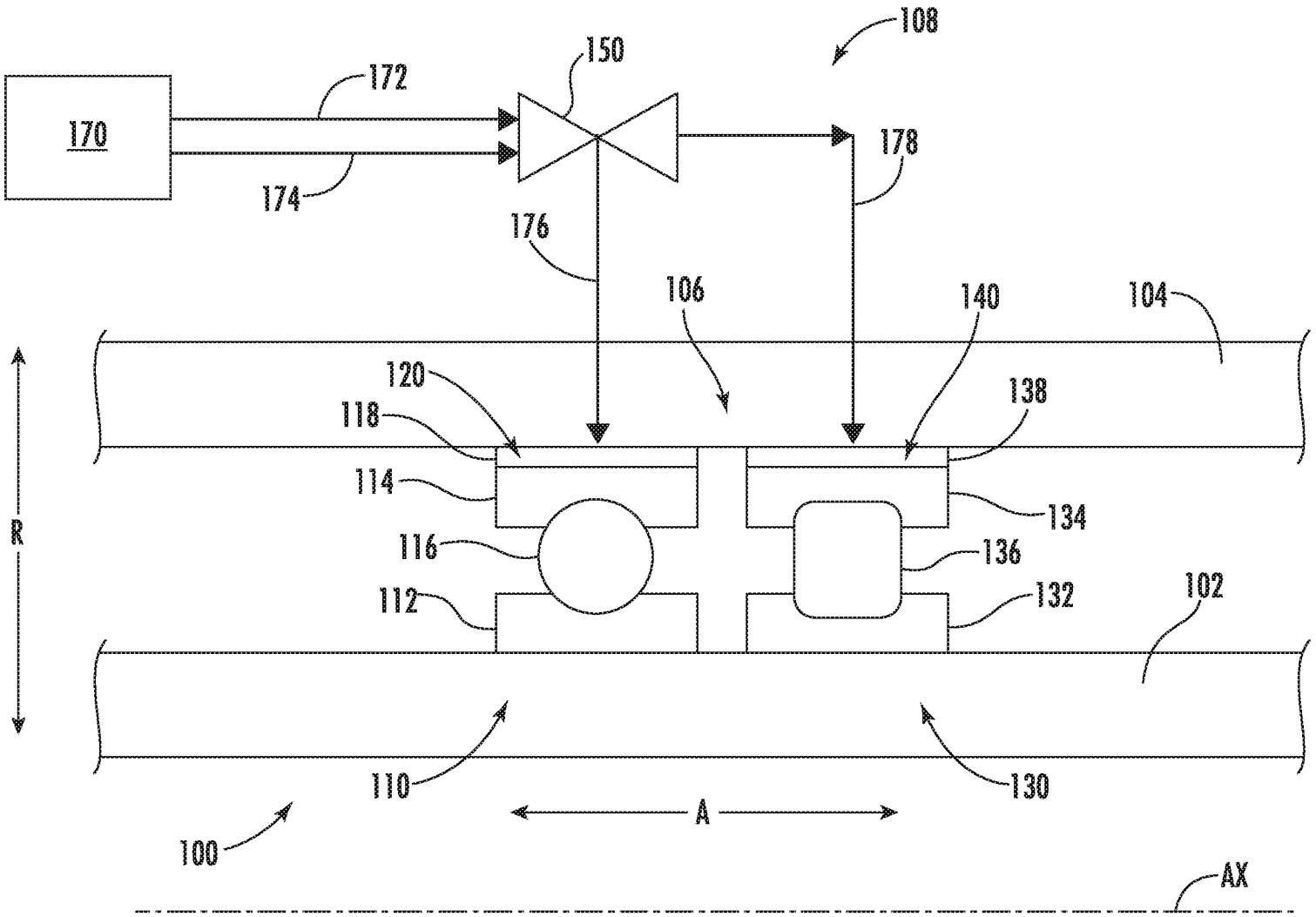
FIG. 2 provides a schematic view of a damping system for a turbomachine according to an example embodiment of the present disclosure.

For instance, as one example, the one or more bearings of the bearing assembly can include a first bearing and a second bearing. The dampers can include a first damper associated with the first bearing and a second damper associated with the second bearing, e.g., as shown in FIG. 2. The first damper defines a first chamber of the one or more chambers and the second damper defines a second chamber of the one or more chambers. In such embodiments, the at least two chambers to which working fluid flows when the valve plunger is in the first position include the first chamber and the second chamber, and when the valve plunger is in the second position, the valve plunger prevents working fluid from flowing to the second chamber.

Figure 5:
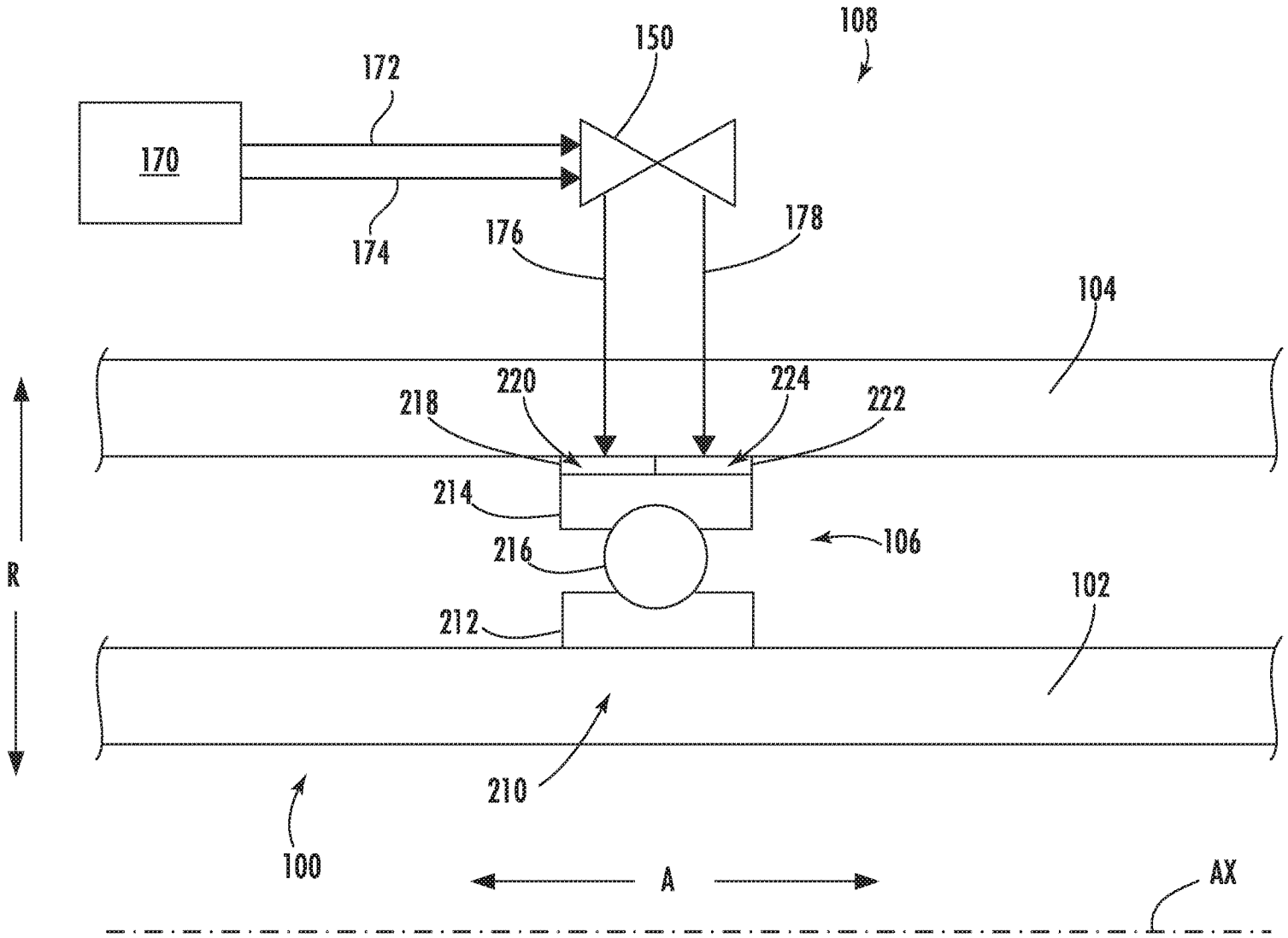
FIG. 5 provides a schematic view of a damping system for a turbomachine according to another example embodiment of the present disclosure.

As another example, the one or more bearings of the bearing assembly can include a single bearing. The dampers can include a first damper associated with the single bearing and a second damper associated with the single bearing, e.g., as shown in FIG. 5. Thus, the single bearing can have two associated dampers. The first damper defines a first chamber of the one or more chambers and the second damper defines a second chamber of the one or more chambers. In such embodiments, the at least two chambers to which working fluid flows when the valve plunger is in the first position can include the first chamber and the second chamber, and when the valve plunger is in the second position, the valve plunger prevents working fluid from flowing to the second chamber. Thus, when the valve plunger is in the second position, working fluid flows to at least one less chamber than when the valve plunger is in the first position. In some embodiments, the first damper and the second damper are integrally formed with one another, but the first chamber and the second chamber remain or are fluidly separate.

Accordingly, as noted in the examples provided above, the at least two chambers can include a first chamber and a second chamber. The first and second chambers can be associated with respective first and second bearings or can be associated with a single bearing. In such embodiments, the turbomachine can include a first valve supply line providing fluid communication between the working fluid supply and a first inlet of the valve chamber. The turbomachine can also include a second valve supply line providing fluid communication between the working fluid supply and a second inlet of the valve chamber. Moreover, in such embodiments, i) when the valve plunger is in the first position, the valve plunger prevents working fluid flowing along the first valve supply line from flowing to the first chamber and from flowing to the second chamber, and ii) when the valve plunger is in the second position, the valve plunger prevents working fluid flowing along the second valve supply line from flowing to the first chamber and from flowing to the second chamber.

In some embodiments, the turbomachine further includes a first damper supply line providing fluid communication between a first outlet of the valve chamber and the first chamber. The turbomachine also includes a second damper supply line providing fluid communication between a second outlet of the valve chamber and the second chamber. In such embodiments, i) when the valve plunger is in the first position, the valve plunger prevents working fluid flowing along the first valve supply line from flowing into the first damper supply line and from flowing into the second damper supply line and allows working fluid flowing along the second valve supply line to flow through the valve chamber and into both the first damper supply line and the second damper supply line, and ii) when the valve plunger is in the second position, the valve plunger prevents working fluid flowing along the second valve supply line from flowing into the first damper supply line or from flowing into the second damper supply line and allows working fluid flowing along the first valve supply line to flow through the valve chamber and into the first damper supply line but not the second damper supply line.

In some further embodiments, the damper control valve defines a first direction and the valve chamber extends between a first end and a second end along the first direction. In such embodiments, a second inlet of the valve chamber is positioned between a first outlet and a second outlet of the valve chamber along the first direction and a first inlet of the valve chamber is positioned at the first end or between the first outlet and the first end of the valve chamber along the first direction. In yet other embodiments, the valve plunger has a plunger head, a plunger disc, and a plunger shaft extending between and connecting the plunger head and the plunger disc. In such embodiments, when the valve plunger is in the first position, working fluid flowing along the second valve supply line flows into the valve chamber between the plunger head and the plunger disc. And further, when the valve plunger is in the second position, working fluid flowing along the first valve supply line flows into the valve chamber but not between the plunger head and the plunger disc.

Notably, in some embodiments, the damper control valve can include a biasing member operable to bias the valve plunger in the first position. In some embodiments, the biasing member can be a spring having a first end and a second end, the first end being coupled with the valve plunger and the second end being coupled with the valve casing. At startup of the turbomachine with the valve plunger biased in the first position, working fluid can be directed to at least two dampers (e.g., a first damper associated with a first bearing and a second damper associated with a second bearing positioned proximate the first bearing). As the engine spools up or increases in speed and thus power output, working fluid flowing downstream along the first valve supply line to the valve chamber reaches a pressure threshold, and when this occurs, the valve plunger overcomes the biasing force applied on the valve plunger by the spring and thus is moved from the first position to the second position. As noted above, actuating the valve plunger to the second position prevents working fluid from flowing to at least one chambers, which effectively reduces the damping stiffness provided to the rotary component.

Advantageously, the turbomachine and damping system therefore provided herein can eliminate the need for minimum damper oil temperature requirement during operation. Minimum damper oil temperature can require extended engine startup time. Further, the turbomachine and damping system therefore provided herein can eliminate the need for other provisions to prevent bowed rotor starts or instability of a rotor during spooling up of the engine. The turbomachine and damping system therefore provided herein may have other advantages and benefits not expressly noted herein.

Referring now to the drawings, FIG. 1 provides a schematic cross-sectional view of a turbomachine embodied as a gas turbine engine for an aerial vehicle. The gas turbine engine of FIG. 1 provides one example environment in which the inventive aspects of the present disclosure can be applied. For the embodiment of FIG. 1, the gas turbine engine is a high-bypass turbofan jet engine 10, referred to herein as "turbofan engine 10." As shown in FIG. 1, the turbofan engine 10 defines an axial direction A (extending parallel to a longitudinal centerline 12 provided for reference) and a radial direction R that is normal to the axial direction A. The turbofan engine 10 also defines a circumferential direction that extends three hundred sixty degrees (360°) around the longitudinal centerline 12.

The turbofan 10 includes a fan section 14 and a core turbine engine 16 disposed downstream of the fan section 14. The core turbine engine 16 includes a substantially tubular outer casing 18 that defines an annular core inlet 20. As schematically shown in FIG. 1, the outer casing 18 encases, in serial flow relationship, a compressor section including a booster or low pressure (LP) compressor 22 followed downstream by a high pressure (HP) compressor 24; a combustion section 26; a turbine section including an HP turbine 28 followed downstream by an LP turbine 30; and a jet exhaust nozzle section 32. The compressor section, combustion section 26, turbine section, and nozzle section 32 together define a core air flowpath. An HP shaft or spool 34 drivingly connects the HP turbine 28 to the HP compressor 24 to rotate them in unison concentrically with respect to the longitudinal centerline 12. An LP shaft or spool 36 drivingly connects the LP turbine 30 to the LP compressor 22 to rotate them in unison concentrically with respect to the longitudinal centerline 12. Thus, the LP shaft 36 and HP shaft 34 are each rotary components, rotating about the axial direction A during operation of the turbofan engine 10.

In order to support such rotary components, the turbofan engine 10 includes a plurality of bearing assemblies 80 attached to various static structural components within the turbofan engine 10. Specifically, for the embodiment depicted in FIG. 1, the bearings 80 support and facilitate rotation of, e.g., the LP shaft 36 and the HP shaft 34. Further, as will be described herein, the bearing assemblies 80 can include one or more dampers operable to dampen vibrational energy imparted to bearings 80 during operation of the turbofan engine 10. Although the bearing assemblies 80 are described and illustrated as being located generally at forward and aft ends of the respective LP shaft 36 and HP shaft 34, the bearings 80 may additionally, or alternatively, be located at any desired location along the LP shaft 36 and HP shaft 34 including, but not limited to, central or mid-span regions of the shafts 34, 36, or other locations along shafts 34, 36.

For the embodiment depicted in FIG. 1, the fan section 14 includes a variable pitch fan 38 having a plurality of fan blades 40 coupled to a disk 42 in a spaced apart manner. The fan blades 40 extend outward from the disk 42 along the radial direction R. Each fan blade 40 is rotatable relative to the disk 42 about a pitch axis P by virtue of the fan blades 40 being operatively coupled to a suitable actuation member 44 configured to collectively vary the pitch of the fan blades 40 in unison. The fan blades 40, disk 42, and actuation member 44 are together rotatable about the longitudinal axis 12 via a fan shaft 45 that is powered by the LP shaft 36 across a power gearbox 46. The power gearbox 46 includes a plurality of gears for adjusting the rotational speed of the fan shaft 45 and thus the fan 38 relative to the LP shaft 36 to a more efficient rotational fan speed. In some embodiments, the fan 38 includes a plurality of fixed-pitch blades 40. Further, in some embodiments, fan 38 is coupled with the LP shaft 36 in a direct drive configuration without power gearbox 46.

Referring still to the exemplary embodiment of FIG. 1, the disk 42 is covered by a rotatable spinner 48 aerodynamically contoured to promote an airflow through the plurality of fan blades 40. Additionally, the exemplary fan section 14 includes an annular fan casing or outer nacelle 50 that circumferentially surrounds the fan 38 and/or at least a portion of the core turbine engine 16. It should be appreciated that the nacelle 50 may be configured to be supported relative to the core turbine engine 16 by a plurality of circumferentially-spaced outlet guide vanes 52. Alternatively, the nacelle 50 also may be supported by struts of a structural fan frame. Moreover, a downstream section 54 of the nacelle 50 may extend over an outer portion of the core turbine engine 16 so as to define a bypass airflow passage 56 therebetween.

During operation of the turbofan engine 10, a volume of air 58 enters the turbofan 10 through an associated inlet 60 of the nacelle 50 and/or fan section 14. As the volume of air 58 passes across the fan blades 40, a first portion of the air 58 as indicated by arrow 62 is directed or routed into the bypass airflow passage 56, and a second portion of the air 58 as indicated by arrow 64 is directed or routed into the upstream section of the core air flowpath, or more specifically into the core inlet 20 of the LP compressor 22. The ratio between the first portion of air 62 and the second portion of air 64 is commonly known as a bypass ratio. The pressure of the second portion of air 64 is then increased as it is routed through the high pressure (HP) compressor 24 and into the combustion section 26, where the highly pressurized air is mixed with fuel and burned to provide combustion gases 66.

The combustion gases 66 are routed into and expand through the HP turbine 28 where a portion of thermal and/or kinetic energy from the combustion gases 66 is extracted via sequential stages of HP turbine stator vanes 68 that are coupled to the outer casing 18 and HP turbine rotor blades 70 that are coupled to the HP shaft or spool 34, thus causing the HP shaft or spool 34 to rotate, thereby supporting operation of the HP compressor 24. The combustion gases 66 are then routed into and expand through the LP turbine 30 where a second portion of thermal and kinetic energy is extracted from the combustion gases 66 via sequential stages of LP turbine stator vanes 72 that are coupled to the outer casing 18 and LP turbine rotor blades 74 that are coupled to the LP shaft or spool 36, thus causing the LP shaft or spool 36 to rotate, thereby supporting operation of the LP compressor 22 and rotation of the fan 38 via the power gearbox 46.

The combustion gases 66 are subsequently routed through the jet exhaust nozzle section 32 of the core turbine engine 16 to provide propulsive thrust. Simultaneously, the pressure of the first portion of air 62 is substantially increased as the first portion of air 62 is routed through the bypass airflow passage 56 before it is exhausted from a fan nozzle exhaust section 76 of the turbofan 10, also providing propulsive thrust. The HP turbine 28, the LP turbine 30, and the jet exhaust nozzle section 32 at least partially define a hot gas path 78 for routing the combustion gases 66 through the core turbine engine 16.

It should be appreciated, however, that the exemplary turbofan engine 10 depicted in FIG. 1 is by way of example only, and that in other exemplary embodiments, the turbofan engine 10 may have any other suitable configuration. For example, in other exemplary embodiments, the fan 38 may be configured in any other suitable manner (e.g., as a fixed pitch fan) and further may be supported using any other suitable fan frame configuration. Moreover, it also should be appreciated that in other exemplary embodiments, any other suitable HP compressor 24 and HP turbine 28 configurations may be utilized. It also should be appreciated, that in still other exemplary embodiments, aspects of the present disclosure may be incorporated into any other suitable gas turbine engine. For example, in other exemplary embodiments, aspects of the present disclosure may be incorporated into, e.g., a turboshaft engine, turboprop engine, turbojet engine, etc. Further, in still other embodiments, aspects of the present disclosure may be incorporated into any other suitable turbomachine, including, without limitation, a steam turbine, a turboshaft, a centrifugal compressor, and/or a turbocharger.

Figure 4:
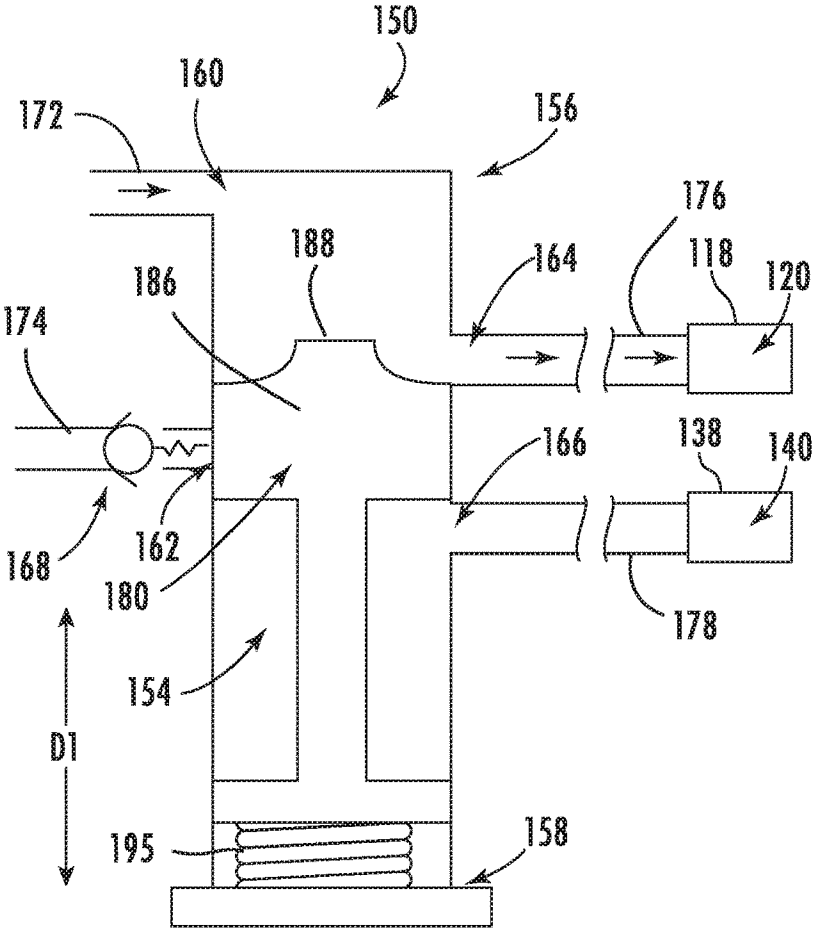
FIG. 4 provides another schematic view of the damper control valve of the damping system of FIG. 2 and depicts the valve plunger in a second position.
Figure 3:
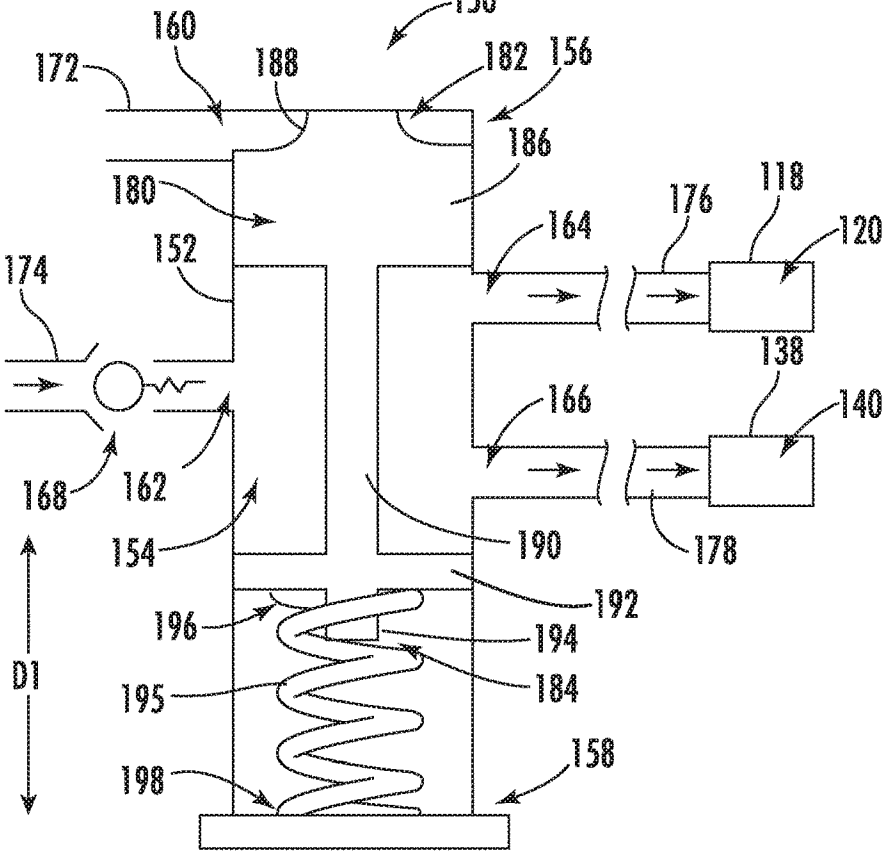
FIG. 3 provides a schematic view of a damper control valve of the damping system of FIG. 2 and depicts a valve plunger of the damper control valve in a first position.

With reference now to FIGS. 2, 3, and 4, an example damping system 108 for a turbomachine 100 is provided according to an example embodiment of the present disclosure. Particularly, FIG. 2 provides a schematic view of the damping system 108 of the turbomachine 100. FIG. 3 provides a schematic view of a damper control valve 150 of the damping system 108 of FIG. 2 and depicts a valve plunger 180 of the damper control valve 150 in a first position. FIG. 4 provides another schematic view of the damper control valve 150 and depicts the valve plunger 180 in a second position. The damping system 108 can be implemented in or incorporated into any suitable turbomachine, such as the turbofan engine 10 of FIG. 1.

As depicted in FIG. 2, the turbomachine 100 includes a rotary component. For this embodiment, the rotary component is a shaft 102 rotatable about an axis of rotation AX, e.g., an axis of rotation that extends along the axial direction A in FIG. 2. One or more components (not shown in FIG. 2) can be connected to and rotatable in unison with the shaft 102. For instance, the shaft 102 can be one of the shafts 34, 36 of the turbofan engine 10 of FIG. 1 and the one or more components connected thereto can be compressor blades, turbine blades, etc. The shaft 102 is supported by a bearing assembly 106 operatively coupled thereto. The bearing assembly 106 can be a forward high speed bearing assembly of an aviation gas turbine engine, for example. For this embodiment, the bearing assembly 106 includes a first bearing 110 operatively coupled with the shaft 102 and a second bearing 130 operatively coupled with the shaft 102. The first bearing 110 and the second bearing 130 are spaced from one another along the axial direction A but are positioned proximate one another, e.g., within at least three feet of one another along the axial direction A.

The first bearing 110 includes an inner race 112 connected to the shaft 102, an outer race 114 connected to a static structure 104 of the turbomachine 100 and bearing elements 116 positioned therebetween (only one shown in FIG. 2). The inner race 112 is positioned inward of the outer race 114 along the radial direction R with respect to the axis of rotation AX. The bearing elements 116 can be spherical balls or other suitable bearing elements, for example. The first bearing 110 has an associated first damper 118 defining a first chamber 120. The first damper 118 can be a squeeze film damper, for example. In some embodiments, the first damper 118 can be integrally formed with the outer race 114 or some other structure of the first bearing 110. In some embodiments, the first damper 118 can be connected or attached to the outer race 114 or some other structure of the first bearing 110. For this embodiment, the first damper 118 is integrally formed with the outer race 114. As will be explained herein, a working fluid (e.g., oil) can be directed into the first chamber 120 of the first damper 118 associated with the first bearing 110. In this manner, the first damper 118 can dampen vibrational loads and provide rotor stability to the shaft 102 and components connected thereto.

Like the first bearing 110, the second bearing 130 includes an inner race 132 connected to the shaft 102, an outer race 134 connected to the static structure 104 of the turbomachine 100, and bearing elements 136 positioned therebetween (only one shown in FIG. 2). The inner race 132 is positioned inward of the outer race 134 along the radial direction R with respect to the axis of rotation AX. The outer race 134 of the second bearing 130 can be connected to the same static structure that the outer race 114 of the first bearing 110 is connected to as shown in FIG. 2, or in some other embodiments, the outer race 134 of the second bearing 130 can be connected to a different static structure. The bearing elements 136 can be rollers or other suitable bearing elements, for example. The second bearing 130 has an associated second damper 138 defining a second chamber 140. The second damper 138 can be a squeeze film damper, for example. In some embodiments, the second damper 138 can be integrally formed with the outer race 134 or some other structure of the second bearing 130. In some embodiments, the second damper 138 can be connected or attached to the outer race 134 or some other structure of the second bearing 130. For this embodiment, the second damper 138 is integrally formed with the outer race 134. A working fluid (e.g., oil) can be directed into the second chamber 140 of the second damper 138. In this manner, the second damper 138 can dampen vibrational loads and provide rotor stability to the shaft 102 and components connected thereto. Notably, the damping response or stiffness provided by the damping system 108 can be varied by controlling the volume of working fluid directed into the second chamber 140.

The damping system 108 also includes a damper control valve 150. Generally, the damper control valve 150 is operable to selectively direct working fluid (e.g., oil) to the second chamber 140 of the second damper 138 to ultimately provide a controlled damping response to the shaft 102 and components connected thereto, or collectively, the rotor or spool. For this embodiment, the damper control valve 150 is a dual-damper control valve. As shown best in FIGS. 3 and 4, the damper control valve 150 has a valve body or casing 152 defining a bore or valve chamber 154. The valve chamber 154 extends between a first end 156 and a second end 158, e.g., along a direction D1. The direction D1 can extend along the longitudinal length of the damper control valve 150, e.g., as shown in FIGS. 3 and 4. Further, the first direction D1 can extend along the axial direction A, or alternatively, along the radial direction R. The first direction D1 can extend along other directions as well. The valve chamber 154 is in fluid communication with the first chamber 120 of the first damper 118, and notably, the valve chamber 154 is in selective fluid communication with the second chamber 140 of the second damper 138.

The valve chamber 154 of the damper control valve 150 is also in fluid communication with a working fluid supply 170. The working fluid supply 170 can be any suitable source or supply of working fluid. For instance, the working fluid supply 170 can be a sump or collection reservoir operable to hold a volume of working fluid. For this embodiment, a first valve supply line 172 provides fluid communication between the working fluid supply 170 and the valve chamber 154. More specifically, the first valve supply line 172 provides fluid communication between the working fluid supply 170 and a first inlet 160 to the valve chamber 154 defined by the casing 152. In addition, a second valve supply line 174 provides fluid communication between the working fluid supply 170 and the valve chamber 154. More particularly, the second valve supply line 174 provides fluid communication between the working fluid supply 170 and a second inlet 162 to the valve chamber 154 defined by the casing 152. The first inlet 160 is spaced form the second inlet 162, e.g., along the first direction D1. Accordingly, the first valve supply line 172 and the second valve supply line 174 both enable working fluid to flow downstream from the working fluid supply 170 to respective inlets 160, 162 of the valve chamber 154.

In some embodiments, the first valve supply line 172 and the second valve supply line 174 directly fluidly couple the working fluid supply 170 with the valve chamber 154, e.g., as shown in FIG. 2. In other embodiments, however, the first valve supply line 172 and the second valve supply line 174 can indirectly fluidly couple the working fluid supply 170 with the valve chamber 154. For instance, a main line can receive working fluid from the working fluid supply 170 and the main line can branch or split into the first valve supply line 172 and the second valve supply line 174. The first valve supply line 172 and the second valve supply line 174 branching from the main line can fluidly coupled respective inlets of the valve chamber 154.

A first damper supply line 176 provides fluid communication between the valve chamber 154 and the first chamber 120 of the first damper 118. More specifically, the first damper supply line 176 provides fluid communication between a first outlet 164 of the valve chamber 154 defined by the casing 152 to the first chamber 120 of the first damper 118. In this way, working fluid can flow downstream from the valve chamber 154 of the damper control valve 150 along the first damper supply line 176 to the first chamber 120. Moreover, a second damper supply line 178 provides fluid communication between the valve chamber 154 and the second chamber 140 of the second damper 138. More particularly, the second damper supply line 178 provides fluid communication between a second outlet 166 of the valve chamber 154 defined by the casing 152 to the second chamber 140 of the second damper 138. In this manner, when the valve plunger 180 of the damper control valve 150 is in the first position (shown in FIG. 3), working fluid can flow downstream from the valve chamber 154 to the second chamber 140 along the second damper supply line 178. The first outlet 164 is spaced form the second outlet 166, e.g., along the first direction D1. Moreover, for this embodiment, the second inlet 162 of the valve chamber 154 is positioned between the first outlet 164 and the second outlet 166 of the valve chamber 154 along the first direction D1. The first inlet 160 of the valve chamber 154 is positioned at the first end 156 or between the first outlet 164 and the first end 156 of the valve chamber 154 along the first direction D1.

As noted above, the damper control valve 150 includes valve plunger 180. The valve plunger 180 extends between a first end 182 and a second end 184, e.g., along the first direction D1. Generally, the valve plunger 180 has a plunger shaft 190, a plunger head 186 connected to the plunger shaft 190 at the first end 182, and a plunger disc 192 connected to the plunger shaft 190 at or proximate the second end 184. The plunger head 186 and the plunger disc 192 are spaced from one another along the first direction D1. Accordingly, the plunger shaft 190 extends between and connects the plunger head 186 and the plunger disc 192. The plunger head 186 has a crown 188. The crown 188 has a smaller cross-section relative to a main portion of the plunger head 186. Particularly, for this embodiment, the crown 188 has a smaller diameter than the main portion of the plunger head 186. The valve plunger 180 includes an extension member 194 that extends further toward the second end 158 of the valve chamber 154 than does the plunger disc 192.

The valve plunger 180 is movable within the valve chamber 154 between a first position (shown in FIG. 3) and a second position (shown in FIG. 4). The damper control valve 150 has a biasing member operable to bias or urge the valve plunger 180 in the first position. For this embodiment, the biasing member is a spring 195 having a first end 196 and a second end 198. The first end 196 of the spring 195 is coupled with the valve plunger 180. More particularly, the first end 196 of the spring 195 is coupled (e.g., connected) with the extension member 194 and plunger disc 192 of the plunger shaft 190. The second end 198 of the spring 195 is coupled (e.g., connected) with the valve casing 152, e.g., at or proximate the second end 158 of the valve chamber 154. In the first position, the spring 195 urges the valve plunger 180 generally toward the first end 156 of the valve chamber 154. The spring 195 urges the valve plunger 180 such that the crown 188 of the plunger head 186 contacts the valve casing 152 at the first end 156, e.g., as shown in FIG. 3. In some embodiments, a bumper (not shown) may be connected to the casing 152 and positioned so that the crown 188 of the plunger head 186 contacts the bumper instead of the casing 152 when the valve plunger 180 is in the first position. In the second position, the valve plunger 180 is moved generally toward the second end 158 of the valve chamber 154. When this occurs, the biasing force of the spring 195 is overcome, causing the spring 195 to contract, e.g., as shown in FIG. 4.

An example manner in which the damper control valve 150 controls the flow of working fluid to the dampers 118, 138 to ultimately control the damping response to vibration loads experienced by the shaft 102 of the turbomachine 100 for a wide range of operational conditions will now be provided.

During engine startup, the valve plunger 180 is biased in the first position. For the depicted embodiment of FIGS. 3 and 4, the valve plunger 180 is biased in the first position by the spring 195. In other implementations, the valve plunger 180 can be biased in the first position in other suitable manners, e.g., electronically by one or more solenoids. Notably, when the valve plunger 180 is in the first position, both dampers 118, 138 are fed working fluid and thus operate to eliminate or reduce rotor instability at lower engine speeds and working fluid temperatures.

More particularly, when the valve plunger 180 is in the first position as shown in FIG. 3, working fluid is permitted to flow to both the first chamber 120 of the first damper 118 and the second chamber 140 of the second damper 138. Specifically, with the valve plunger 180 biased in the first position by the spring 195, working fluid flowing along the second valve supply line 174 overcomes a check valve 168 positioned along the second valve supply line 174 upstream of the second inlet 162. The working fluid flows past the check valve 168 and into the valve chamber 154. The working fluid enters the valve chamber 154 via the second inlet 162 and flows between the plunger head 186 and the plunger disc 192 as shown in FIG. 3. Accordingly, when the valve plunger 180 is in the first position, working fluid is permitted to flow from working fluid supply 170 (FIG. 2) downstream along the second valve supply line 174 and into the valve chamber 154 of the damper control valve 150, and due to the valve plunger 180 being positioned in the first position, the working fluid can flow downstream along the first damper supply line 176 to the first chamber 120 of the first damper 118 and downstream along the second damper supply line 178 to the second chamber 140 of the second damper 138. When both dampers 118, 138 are supplied working fluid, both dampers 118, 138 act to damp the shaft 102 in order to keep the shaft 102 stable, e.g., during an engine start condition.

Further, when the valve plunger 180 is in the first position, the valve plunger 180 prevents working fluid flowing along the first valve supply line 172 from flowing to either the first chamber 120 of the first damper 118 or the second chamber 140 of the second damper 138. As depicted in FIG. 3, the plunger head 186 of valve plunger 180 prevents working fluid from flowing from the first valve supply line 172 to either the first outlet 164 or the second outlet 166 of the valve chamber 154.

As the turbomachine 100 spools up, the pressure of the working fluid increases. Particularly, as the turbomachine 100 spools up, the temperature and the pressure of the working fluid increases. When the working fluid reaches a pressure threshold, the working fluid flowing along the first valve supply line 172 and engaging the plunger head 186 proximate crown 188 overcomes the biasing force that the spring 195 applies on the valve plunger 180 and moves the valve plunger 180 toward the second end 158 of the valve chamber 154 along the first direction D1. As the pressure and temperature of the working fluid continues to increase, the working fluid continues to move the valve plunger 180 toward the second end 158 of the valve chamber 154 along the first direction D1 until the valve plunger 180 reaches the second position shown in FIG. 4. As depicted in FIG. 4, the spring 195 contracts due to the force that the working fluid flowing along the first valve supply line 172 applies to the valve plunger 180 at or proximate crown 188.

As shown best in FIG. 4, when the valve plunger 180 is in the second position, working fluid flows to the first chamber 120 of the first damper 118 but not to the second chamber 140 of the second damper 138. Specifically, with the valve plunger 180 moved to the second position, working fluid flowing along the first valve supply line 172 enters the valve chamber 254 through the first inlet 160. The working fluid flows into valve chamber 254 and exits via the first outlet 164. The working fluid exiting through the first outlet 164 continues downstream along the first damper supply line 176 to the first damper chamber 120 of the first damper 118. When the valve plunger 180 is in the second position, the plunger head 186 prevents working fluid flowing along the first valve supply line 172 to exit the valve chamber 254 through the second outlet 166; thus, second chamber 140 of the second damper 138 does not receive working fluid from the first valve supply line 172 when the valve plunger 180 is in the second position.

Moreover, when the valve plunger 180 is in the second position, the valve plunger 180 prevents working fluid flowing along the second valve supply line 174 from flowing to either the first chamber 120 of the first damper 118 or the second chamber 140 of the second damper 138. Accordingly, when the valve plunger 180 is in the second position, no working fluid is supplied to the second chamber 140 of the second damper 138. Further, as depicted in FIG. 4, working fluid flowing along the second valve supply line 174 is prevented from entering the valve chamber 254 through the second inlet 162 when the valve plunger 180 is in the second position. Blocking working fluid to the second damper 138 reduces the bearing assembly 106 damping stiffness, which may be suitable for an engine high power condition.

After the turbomachine 100 ceases operating in the high power condition or operating at all, the pressure and temperature of the working fluid decreases. As the pressure of the working fluid decreases, the biasing force that the spring 195 applies to the valve plunger 180 eventually overcomes the force that the working fluid applies to the valve plunger 180, causing the valve plunger 180 to move toward the first end 156 of the valve chamber 154. At some point, the valve plunger 180 returns to the first position shown in FIG. 3. In this manner, the damper control valve advantageously controls the flow of working fluid to the dampers to optimize the bearing damping response to vibrational loads on the shaft 102 based on the operating conditions of the turbomachine 100.

Although the damper control valve 150 was described above as being controlled based on the pressure of the working fluid, it will be appreciated that the damper control valve 150 can be controlled in other suitable manners as well. For instance, in some embodiments, the damper control valve 150 can be electronically controlled, e.g., by one or more solenoids. The damper control valve 150 can be controlled by other means as well, such as by speed of the shaft or based on thermal inputs.

FIG. 5 provides a schematic view of another example damping system 108 for a turbomachine 100 according to an example embodiment of the present disclosure. The same reference numerals used in FIG. 5 denote the same elements in FIGS. 2, 3, and 4; thus, detailed descriptions of the same elements will be omitted.

For the depicted embodiment of FIG. 5, the bearing assembly 106 has a single bearing 210. The bearing 210 includes an inner race 212 connected to the shaft 102, an outer race 214 connected to the static structure 104 of the turbomachine 100 and bearing elements 216 positioned therebetween (only one shown in FIG. 5). The inner race 212 is positioned inward of the outer race 214 along the radial direction R with respect to the axis of rotation AX of the shaft 102. The bearing elements 216 can be spherical balls or other suitable bearing elements, for example. The bearing 210 has an associated first damper 218 defining a first chamber 220 and an associated second damper 222 defining a second chamber 224. The first damper 218 and the second damper 222 can both be squeeze film dampers, for example. In some embodiments, the first damper 218 and/or the second damper 222 can be integrally formed with the outer race 214 or some other structure of the bearing 210 (e.g., a bearing housing). In some embodiments, the first damper 218 and/or second damper 222 can be connected or attached to the outer race 214 or some other structure of the bearing 210. For this embodiment, the first damper 218 and the second damper 222 are integrally formed with the outer race 214.

As noted above with respect to the embodiment of FIGS. 2, 3, and 4, the damper control valve 150 can be controlled to direct a working fluid (e.g., oil) into both the first chamber 220 and the second chamber 224 of the first and second dampers 218, 222 associated with the bearing 210, e.g., when the valve plunger of the damper control valve 150 is in the first position. This increases the stiffness of the damping response provided to the shaft 102, which may be beneficial to control rotor instability during an engine start condition or engine startup. Also, the damper control valve 150 can be controlled to direct working fluid into the first chamber 220 of the first damper 218 but not the second chamber 224 of the second damper 222, e.g., when the valve plunger is in the second position. This decreases the stiffness of the damping response provided to the shaft 102, which may be beneficial for controlling vibrational loads during an engine high power or speed condition. The damper control valve 150 can be controlled based on the pressure of the working fluid as described above or can be controlled in other suitable manners noted herein.

In some alternative embodiments, the damping system 108 of FIG. 5 can be configured as described above except that the first damper 218 and the second damper 222 can be integrally formed with one another but the first chamber 220 and the second chamber 224 remain or are fluidly separate or isolated.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

Further aspects of the invention are provided by the subject matter of the following clauses:

1. A turbomachine comprising: a rotary component rotatable about an axis of rotation; a bearing assembly having one or more bearings each operatively coupled with the rotary component, each of the one or more bearings having a damper associated therewith, each of the dampers defining one or more chambers; a damper control valve having a valve casing defining a valve chamber, the valve chamber being in fluid communication with a working fluid supply and the one or more chambers, the damper control valve operable to receive working fluid from the working fluid supply, and wherein the damper control valve has a valve plunger movable within the valve chamber between a first position in which working fluid flows to at least two chambers of the one or more chambers and a second position in which working fluid flows to at least one less chamber than the at least two chambers to which working fluid flows when the valve plunger is in the first position.

2. The turbomachine of any preceding clause, wherein the damper control valve has a biasing member operable to bias the valve plunger in the first position.

3. The turbomachine of any preceding clause, wherein the biasing member is a spring having a first end and a second end, the first end being coupled with the valve plunger and the second end being coupled with the valve casing.

4. The turbomachine of any preceding clause, wherein the at least two chambers include a first chamber and a second chamber, and wherein the turbomachine further comprises: a first valve supply line providing fluid communication between the working fluid supply and a first inlet of the valve chamber; a second valve supply line providing fluid communication between the working fluid supply and a second inlet of the valve chamber, and wherein: i) when the valve plunger is in the first position, the valve plunger prevents working fluid flowing along the first valve supply line from flowing to the first chamber and from flowing to the second chamber, and ii) when the valve plunger is in the second position, the valve plunger prevents working fluid flowing along the second valve supply line from flowing to the first chamber and from flowing to the second chamber.

5. The turbomachine of any preceding clause, further comprising: a first damper supply line providing fluid communication between a first outlet of the valve chamber and the first chamber; a second damper supply line providing fluid communication between a second outlet of the valve chamber and the second chamber; and wherein: i) when the valve plunger is in the first position, the valve plunger prevents working fluid flowing along the first valve supply line from flowing into the first damper supply line and from flowing into the second damper supply line and allows working fluid flowing along the second valve supply line to flow through the valve chamber and into both the first damper supply line and the second damper supply line, and ii) when the valve plunger is in the second position, the valve plunger prevents working fluid flowing along the second valve supply line from flowing into the first damper supply line or from flowing into the second damper supply line and allows working fluid flowing along the first valve supply line to flow through the valve chamber and into the first damper supply line but not the second damper supply line.

6. The turbomachine of any preceding clause, wherein the valve plunger has a plunger head, a plunger disc, and a plunger shaft extending between and connecting the plunger head and the plunger disc, and wherein when the valve plunger is in the first position, working fluid flowing along the second valve supply line flows into the valve chamber between the plunger head and the plunger disc.

7. The turbomachine of any preceding clause, wherein when working fluid flowing downstream along the first valve supply line to the valve chamber reaches a pressure threshold, the valve plunger is moved from the first position to the second position.

8. The turbomachine of any preceding clause, wherein the one or more bearings of the bearing assembly include a first bearing and a second bearing, and wherein a first damper of the dampers is associated with the first bearing and a second damper of the dampers is associated with the second bearing, and wherein first damper defines a first chamber of the one or more chambers and the second damper defines a second chamber of the one or more chambers, and wherein the at least two chambers to which working fluid flows when the valve plunger is in the first position include the first chamber and the second chamber, and when the valve plunger is in the second position, the valve plunger prevents working fluid from flowing to the second chamber.

9. The turbomachine of any preceding clause, wherein the one or more bearings of the bearing assembly include a single bearing, and wherein a first damper of the dampers is associated with the single bearing and a second damper of the dampers is associated with the single bearing, and wherein first damper defines a first chamber of the one or more chambers and the second damper defines a second chamber of the one or more chambers, and wherein the at least two chambers to which working fluid flows when the valve plunger is in the first position include the first chamber and the second chamber, and when the valve plunger is in the second position, the valve plunger prevents working fluid from flowing to the second chamber.

10. The turbomachine of any preceding clause, wherein the turbomachine is a gas turbine engine for an aerial vehicle.

11. A gas turbine engine, comprising: a rotary component rotatable about an axis of rotation; a first bearing operatively coupled with the rotary component; a first damper associated with the first bearing, the first damper defining a first chamber; a second bearing operatively coupled with the rotary component; a second damper associated with the second bearing, the second damper defining a second chamber; and a damper control valve having a valve casing defining a valve chamber, the valve chamber being in fluid communication with the first chamber of the first damper and being in selective fluid communication with the second chamber of the second damper, wherein the damper control valve has a valve plunger movable within the valve chamber between a first position in which working fluid flows to both the first chamber and the second chamber and a second position in which working fluid flows to the first chamber but not the second chamber.

12. The gas turbine engine of any preceding clause, further comprising: a working fluid supply operable to store working fluid; a first valve supply line providing fluid communication between the working fluid supply and a first inlet of the valve chamber; a second valve supply line providing fluid communication between the working fluid supply and a second inlet of the valve chamber, and wherein: i) when the valve plunger is in the first position, the valve plunger prevents working fluid flowing along the first valve supply line from flowing to the first chamber and from flowing to the second chamber, and ii) when the valve plunger is in the second position, the valve plunger prevents working fluid flowing along the second valve supply line from flowing to the first chamber and from flowing to the second chamber.

13. The gas turbine engine of any preceding clause, further comprising: a first damper supply line providing fluid communication between a first outlet of the valve chamber and the first chamber; a second damper supply line providing fluid communication between a second outlet of the valve chamber and the second chamber; and wherein: i) when the valve plunger is in the first position, the valve plunger prevents working fluid flowing along the first valve supply line from flowing into the first damper supply line and from flowing into the second damper supply line and allows working fluid flowing along the second valve supply line to flow through the valve chamber and into both the first damper supply line and the second damper supply line, and ii) when the valve plunger is in the second position, the valve plunger prevents working fluid flowing along the second valve supply line from flowing into the first damper supply line or from flowing into the second damper supply line and allows working fluid flowing along the first valve supply line to flow through the valve chamber and into the first damper supply line but not the second damper supply line.

14. The gas turbine engine of any preceding clause, wherein the valve plunger has a plunger head, a plunger disc, and a plunger shaft extending between and connecting the plunger head and the plunger disc, and wherein when the valve plunger is in the first position, working fluid flowing along the second valve supply line flows into the valve chamber between the plunger head and the plunger disc.

15. The gas turbine engine of any preceding clause, wherein the damper control valve defines a first direction and the valve chamber extends between a first end and a second end along the first direction, and wherein a second inlet of the valve chamber is positioned between a first outlet and a second outlet of the valve chamber along the first direction and wherein a first inlet of the valve chamber is positioned at the first end or between the first outlet and the first end of the valve chamber along the first direction.

16. A gas turbine engine, comprising: a rotary component rotatable about an axis of rotation; a bearing operatively coupled with the rotary component; a first damper associated with the bearing, the first damper defining a first chamber; a second damper associated with the bearing, the second damper defining a second chamber; a damper control valve having a valve casing defining a valve chamber, the valve chamber being in fluid communication with the first chamber of the damper and being in selective fluid communication with the second chamber of the damper, wherein the damper control valve has a valve plunger movable within the valve chamber between a first position in which working fluid flows to both the first chamber and the second chamber and a second position in which working fluid flows to the first chamber but not the second chamber.

17. The gas turbine engine of any preceding clause, wherein the rotary component is a high pressure shaft of the gas turbine engine.

18. The gas turbine engine of any preceding clause, further comprising: a working fluid supply operable to store working fluid; a first valve supply line providing fluid communication between the working fluid supply and a first inlet of the valve chamber; a second valve supply line providing fluid communication between the working fluid supply and a second inlet of the valve chamber, and wherein: i) when the valve plunger is in the first position, the valve plunger prevents working fluid flowing along the first valve supply line from flowing to the first chamber and from flowing to the second chamber, and ii) when the valve plunger is in the second position, the valve plunger prevents working fluid flowing along the second valve supply line from flowing to the first chamber and from flowing to the second chamber.

19. The gas turbine engine of any preceding clause, further comprising: a first damper supply line providing fluid communication between a first outlet of the valve chamber and the first chamber; a second damper supply line providing fluid communication between a second outlet of the valve chamber and the second chamber; and wherein: i) when the valve plunger is in the first position, the valve plunger prevents working fluid flowing along the first valve supply line from flowing into the first damper supply line and from flowing into the second damper supply line and allows working fluid flowing along the second valve supply line to flow through the valve chamber and into both the first damper supply line and the second damper supply line, and ii) when the valve plunger is in the second position, the valve plunger prevents working fluid flowing along the second valve supply line from flowing into the first damper supply line or from flowing into the second damper supply line and allows working fluid flowing along the first valve supply line to flow through the valve chamber and into the first damper supply line but not the second damper supply line.

20. The gas turbine engine of any preceding clause, wherein the first damper and the second damper are integrally formed with one another, but the first chamber and the second chamber are fluidly separate.

What is claimed is:

1. A turbomachine, comprising:

a rotary component rotatable about an axis of rotation;

a bearing assembly having one or more bearings each operatively coupled with the rotary component, each of the one or more bearings having one or more dampers associated therewith, wherein the one or more dampers define two or more chambers;

a damper control valve having a valve casing defining a valve chamber, the valve chamber being in fluid communication with a working fluid supply and the two or more chambers, the damper control valve operable to receive working fluid from the working fluid supply through two or more valve supply lines in fluid communication between the working fluid supply and the valve chamber, and wherein the damper control valve has a valve plunger movable within the valve chamber between a first position in which working fluid flows through one or more first valve supply lines of the two or more valve supply lines to at least two chambers of the two or more chambers and a second position in which working fluid flows through one or more second valve supply lines of the two or more valve supply lines to at least one less chamber than the at least two chambers to which working fluid flows when the valve plunger is in the first position.

2. The turbomachine of claim 1, wherein the damper control valve has a biasing member operable to bias the valve plunger in the first position.

3. The turbomachine of claim 2, wherein the biasing member is a spring having a first end and a second end, the first end being coupled with the valve plunger and the second end being coupled with the valve casing.

4. The turbomachine of claim 1, wherein the two or more chambers include a first chamber and a second chamber, and wherein:

i) when the valve plunger is in the first position, the valve plunger prevents working fluid flowing along the one or more first valve supply lines from flowing to the first chamber and from flowing to the second chamber, and ii) when the valve plunger is in the second position, the valve plunger prevents working fluid flowing along the one or more second valve supply lines from flowing to the first chamber and from flowing to the second chamber.

5. The turbomachine of claim 4, further comprising:

a first damper supply line providing fluid communication between a first outlet of the valve chamber and the first chamber;

a second damper supply line providing fluid communication between a second outlet of the valve chamber and the second chamber; and wherein:

i) when the valve plunger is in the first position, the valve plunger prevents working fluid flowing along the one or more first valve supply lines from flowing into the first damper supply line and from flowing into the second damper supply line and allows working fluid flowing along the one or more second valve supply lines to flow through the valve chamber and into both the first damper supply line and the second damper supply line, and ii) when the valve plunger is in the second position, the valve plunger prevents working fluid flowing along the one or more second valve supply lines from flowing into the first damper supply line or from flowing into the second damper supply line and allows working fluid flowing along the one or more first valve supply lines to flow through the valve chamber and into the first damper supply line but not the second damper supply line.

6. The turbomachine of claim 5, wherein the valve plunger has a plunger head, a plunger disc, and a plunger shaft extending between and connecting the plunger head and the plunger disc, and wherein when the valve plunger is in the first position, working fluid flowing along the one or more second valve supply lines flows into the valve chamber between the plunger head and the plunger disc.

7. The turbomachine of claim 4, wherein when working fluid flowing downstream along the one or more first valve supply lines to the valve chamber reaches a pressure threshold, the valve plunger is moved from the first position to the second position.

8. The turbomachine of claim 1, wherein the one or more bearings of the bearing assembly include a first bearing and a second bearing, and wherein a first damper of the one or more dampers is associated with the first bearing and a second damper of the one or more dampers is associated with the second bearing, and wherein the first damper defines a first chamber of the two or more chambers and the second damper defines a second chamber of the two or more chambers, and wherein the at least two chambers of the two or more chambers to which working fluid flows when the valve plunger is in the first position include the first chamber and the second chamber, and when the valve plunger is in the second position, the valve plunger prevents working fluid from flowing to the second chamber.

9. The turbomachine of claim 1, wherein the one or more bearings of the bearing assembly include a single bearing, and wherein a first damper of the one or more dampers is associated with the single bearing and a second damper of the one or more dampers is associated with the single bearing, and wherein the first damper defines a first chamber of the two or more chambers and the second damper defines a second chamber of the two or more chambers, and wherein the at least two chambers of the two or more chambers to which working fluid flows when the valve plunger is in the first position include the first chamber and the second chamber, and when the valve plunger is in the second position, the valve plunger prevents working fluid from flowing to the second chamber.

10. The turbomachine of claim 1, wherein the turbomachine is a gas turbine engine for an aerial vehicle.

11. A gas turbine engine, comprising:

a rotary component rotatable about an axis of rotation;

a first bearing operatively coupled with the rotary component;

a first damper associated with the first bearing, the first damper defining a first chamber;

a second bearing operatively coupled with the rotary component;

a second damper associated with the second bearing, the second damper defining a second chamber; and a damper control valve having a valve casing defining a valve chamber, the valve chamber being in fluid communication with the first chamber of the first damper and being in selective fluid communication with the second chamber of the second damper, wherein the damper control valve has a valve plunger movable within the valve chamber between a first position in which working fluid flows to both the first chamber and the second chamber and a second position in which working fluid flows to the first chamber but not the second chamber.

12. The gas turbine engine of claim 11, further comprising:

a working fluid supply operable to store working fluid;

a first valve supply line providing fluid communication between the working fluid supply and a first inlet of the valve chamber;

a second valve supply line providing fluid communication between the working fluid supply and a second inlet of the valve chamber, and wherein:

i) when the valve plunger is in the first position, the valve plunger prevents working fluid flowing along the first valve supply line from flowing to the first chamber and from flowing to the second chamber, and ii) when the valve plunger is in the second position, the valve plunger prevents working fluid flowing along the second valve supply line from flowing to the first chamber and from flowing to the second chamber.

13. The gas turbine engine of claim 12, further comprising:

a first damper supply line providing fluid communication between a first outlet of the valve chamber and the first chamber;

a second damper supply line providing fluid communication between a second outlet of the valve chamber and the second chamber; and wherein:

i) when the valve plunger is in the first position, the valve plunger prevents working fluid flowing along the first valve supply line from flowing into the first damper supply line and from flowing into the second damper supply line and allows working fluid flowing along the second valve supply line to flow through the valve chamber and into both the first damper supply line and the second damper supply line, and ii) when the valve plunger is in the second position, the valve plunger prevents working fluid flowing along the second valve supply line from flowing into the first damper supply line or from flowing into the second damper supply line and allows working fluid flowing along the first valve supply line to flow through the valve chamber and into the first damper supply line but not the second damper supply line.

14. The gas turbine engine of claim 12, wherein the valve plunger has a plunger head, a plunger disc, and a plunger shaft extending between and connecting the plunger head and the plunger disc, and wherein when the valve plunger is in the first position, working fluid flowing along the second valve supply line flows into the valve chamber between the plunger head and the plunger disc.

15. The gas turbine engine of claim 11, wherein the damper control valve defines a first direction and the valve chamber extends between a first end and a second end along the first direction, and wherein a second inlet of the valve chamber is positioned between a first outlet and a second outlet of the valve chamber along the first direction and wherein a first inlet of the valve chamber is positioned at the first end or between the first outlet and the first end of the valve chamber along the first direction.

16. A gas turbine engine, comprising:

a rotary component rotatable about an axis of rotation;

a bearing operatively coupled with the rotary component;

a first damper associated with the bearing, the first damper defining a first chamber;

a second damper associated with the bearing, the second damper defining a second chamber;

a damper control valve having a valve casing defining a valve chamber, the valve chamber being in fluid communication with the first chamber of the first damper and being in selective fluid communication with the second chamber of the second damper, wherein the damper control valve has a valve plunger movable within the valve chamber between a first position in which working fluid flows through one or more first valve supply lines to both the first chamber and the second chamber and a second position in which working fluid flows through one or more second valve supply lines to the first chamber but not the second chamber.

17. The gas turbine engine of claim 16, wherein the rotary component is a high pressure shaft of the gas turbine engine.

18. The gas turbine engine of claim 16, further comprising:

a working fluid supply operable to store working fluid, wherein the one or more first valve supply lines provide fluid communication between the working fluid supply and the valve chamber, wherein the one or more second valve supply lines provide fluid communication between the working fluid supply and the valve chamber, and wherein:

i) when the valve plunger is in the first position, the valve plunger prevents working fluid flowing along the one or more first valve supply lines from flowing to the first chamber and from flowing to the second chamber, and ii) when the valve plunger is in the second position, the valve plunger prevents working fluid flowing along the one or more second valve supply lines from flowing to the first chamber and from flowing to the second chamber.

19. The gas turbine engine of claim 18, further comprising:

a first damper supply line providing fluid communication between a first outlet of the valve chamber and the first chamber;

a second damper supply line providing fluid communication between a second outlet of the valve chamber and the second chamber; and wherein:

i) when the valve plunger is in the first position, the valve plunger prevents working fluid flowing along the one or more first valve supply lines from flowing into the first damper supply line and from flowing into the second damper supply line and allows working fluid flowing along the one or more second valve supply lines to flow through the valve chamber and into both the first damper supply line and the second damper supply line, and ii) when the valve plunger is in the second position, the valve plunger prevents working fluid flowing along the one or more second valve supply lines from flowing into the first damper supply line or from flowing into the second damper supply line and allows working fluid flowing along the one or more first valve supply lines to flow through the valve chamber and into the first damper supply line but not the second damper supply line.

20. The gas turbine engine of claim 16, wherein the first damper and the second damper are integrally formed with one another, but the first chamber and the second chamber are fluidly separate.

* * * * *